US007241149B2

(12) United States Patent
Abadia

(10) Patent No.: US 7,241,149 B2
(45) Date of Patent: Jul. 10, 2007

(54) INTERPOSED ELECTRICAL CONNECTOR WHICH IS INTENDED TO CONNECT TWO STACKED ELECTRONIC CIRCUITS AND TO THE METHOD OF MOUNTING SAME

(75) Inventor: Roger Abadia, Neuilly-Plaisance (FR)

(73) Assignee: Valeo Equipments Electriques Moteur, Creteil Cedex (FR)

( * ) Notice: Subject to any disclaimer, the term of this patent is extended or adjusted under 35 U.S.C. 154(b) by 0 days.

(21) Appl. No.: 10/554,487

(22) PCT Filed: Apr. 28, 2004

(86) PCT No.: PCT/FR2004/001020

§ 371 (c)(1),
(2), (4) Date: Oct. 26, 2005

(87) PCT Pub. No.: WO2004/097998

PCT Pub. Date: Nov. 11, 2004

(65) Prior Publication Data

US 2006/0234524 A1 Oct. 19, 2006

(30) Foreign Application Priority Data

Apr. 28, 2003 (FR) ..... 03 05170

(51) Int. Cl.
*H01R 12/00* (2006.01)

(52) U.S. Cl. ..... 439/75; 439/378

(58) Field of Classification Search ..... 439/74, 439/75, 82, 83, 567, 876, 943, 378
See application file for complete search history.

(56) References Cited

U.S. PATENT DOCUMENTS 4,173,387 A * 11/1979 Zell ..... 439/557

(Continued)

FOREIGN PATENT DOCUMENTS

FR 2745444 A 8/1997

OTHER PUBLICATIONS

ISA/EP, International Search Report, PCT/FR2004/001020, Dec. 2, 2004, 3 pages.

(Continued)

*Primary Examiner*—Tho D. Ta
(74) *Attorney, Agent, or Firm*—Osha Liang LLP

(57) ABSTRACT

The invention relates to an interposed electrical connector which is intended to connect two stacked electronic circuits and to the method of mounting same. The inventive connector (1) comprising plugs (4) which are borne by a base (4), a guide (11) and guide means (12) which are disposed between the guide and the base. According to the invention, at least some of the aforementioned plugs (4) project out from the base (10) such that they can be slid into a housing (13) that passes through the guide (11). The guide means (12) comprise a first projecting part (14) which is solidly connected to the base (10) and a second complementary part (15) which is solidly connected to the guide (11). The base (10) is intended to be fixed to a first circuit while the first part (14) of the guide means (12) is intended to be guided through the second part (15) of the guide means (12) as well as a second circuit (3). The mounting method is characterised in that the guide masks the free ends of the plugs before the connector is mounted to the circuits thereof.

19 Claims, 2 Drawing Sheets

U.S. PATENT DOCUMENTS 4,558,912 A * 12/1985 Coller et al. ..... 439/246
5,059,130 A 10/1991 Miller, Jr.
5,340,319 A * 8/1994 Enomoto et al. ..... 439/75
5,575,686 A 11/1996 Noschese
6,039,581 A * 3/2000 DiMarco ..... 439/75
6,201,709 B1 3/2001 Justiniano et al.
6,431,886 B1 8/2002 Ramey et al.

OTHER PUBLICATIONS

English Abstract of Patent No. FR2745444.

* cited by examiner

Fig. 2
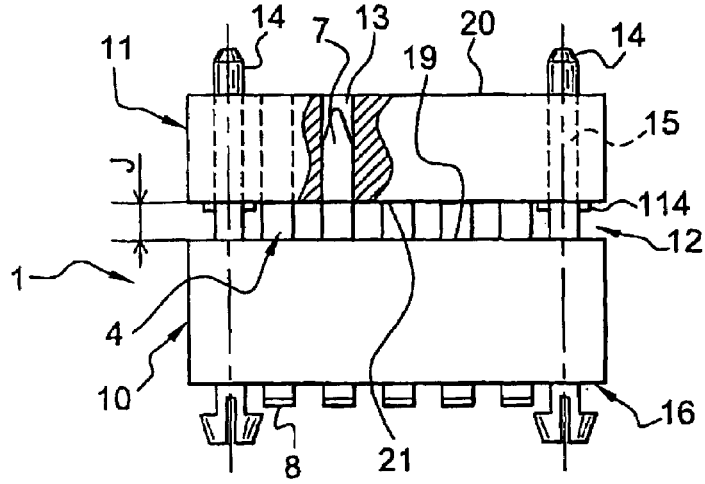
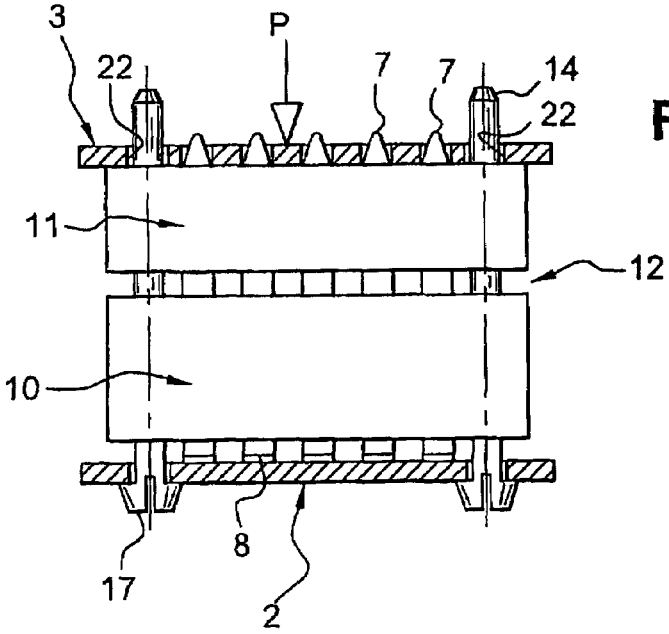
Fig. 3
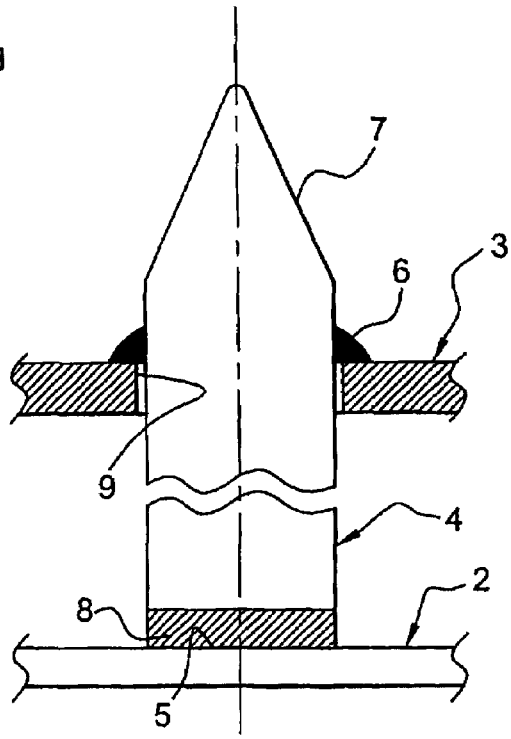
Fig. 4

INTERPOSED ELECTRICAL CONNECTOR WHICH IS INTENDED TO CONNECT TWO STACKED ELECTRONIC CIRCUITS AND TO THE METHOD OF MOUNTING SAME

FIELD OF THE INVENTION

The present invention relates to an inserted electrical connector for interlinking two superimposed electronic circuits, in particular a first electronic circuit pertaining to a power stage and a second electronic circuit pertaining to a control stage mounted in an electronic command and control box of an automobile alternator-starter, for example as described in patent FR A 2 745 444, which will be referred to for further details.

Generally speaking, the invention is applicable to every step-up device that uses an inserted connector for passing electronic information from a first electronic circuit to a second electronic circuit installed on the first electronic circuit.

In this instance, electronic circuit is understood to be any circuit comprising electrical and/or electronic components.

The present invention also relates to a method for mounting the connector.

PRIOR ART

One can envision the use of a connector bearing electrically conductive plugs, also known as pins, each intended for making an electrical connection between a first electrical contact area on the first electronic circuit and a second electrical contact area on the second electronic circuit.

DISCLOSURE OF THE INVENTION

The ability to accurately position the plugs with regard to the electrical contact areas of the electronic circuits may be desirable.

A design involving a connector forming a subassembly may be desirable.

The present invention relates to a response to these desires.

In accordance with the invention, an inserted connector of the abovementioned type is characterized by the fact that it has a base made of an electrically insulating material for attaching the plugs and a guiding means located between the guide and the base, wherein at least some of the plugs protrude from the base so that the free end of each of them can be inserted to slide inside a housing passing through the guide and wherein the guiding means comprise a first protruding part attached to the base and an additional second part mounted on the first part and attached to the guide.

In one embodiment, the base is intended to be attached to the first circuit, such as a power circuit, while the first part of the guiding means is intended to pass through and guide the second part of the guiding means as well as the second circuit, such as a circuit with less power, for example comprising logical circuits.

The structures can naturally be reversed.

In a variation, the base is intended to be attached to the second circuit while the first part of the guiding means is intended to pass through and guide the second part of the guiding means as well as the first circuit.

Accordingly, the first part of the guiding means projects from the base to a height above that of the projecting part of the plugs with regard to the base.

In accordance with the invention, the plugs are properly positioned with regard to the first and second electrical contract areas.

In fact, the base serves to attach and position the plugs, for example on the first circuit while initially, before being mounted on this first circuit, the second part of the guiding means is inserted into the first part of the guiding means attached to the base outfitted with plugs, after which the guide is moved toward the base so that each of the free ends of the plugs in embedded into its housing on the guide. Advantageously this movement is halted so that the free ends of the plugs are embedded in their housing and covered by the housing, tantamount to a preassembly position of the connector.

Thus we obtain an assembly that can be readily handled and moved, with the free ends of the plugs now protected and not exposed by virtue of being covered by the guide at this point, while the first part of the guiding means passes through the guide. The plugs are therefore not bent while they are moved and handled.

Next, the first circuit is attached to the plugs here or elsewhere, for example by soldering, and to the base, for example by snapping together, so that the plugs are electrically connected to the first electrical contact areas pertaining to this first circuit.

Next, in this embodiment the second circuit is attached to the first part of the guiding means in a simple and quick fashion. This circuit then contacts the upper face of the guide and serves as a pressure plate to move the guide, owing to the guiding means, with regard to the base, until the plugs travel far enough to be connected to the second electrical contact areas attached to this second circuit.

The plugs are then attached to the second electrical areas, for example by soldering.

Naturally, as a variation the structures can be reversed so that, once the easily handled and moved subassembly has been created, the second circuit is attached to the plugs and then the first circuit is fitted onto the guiding means.

Accordingly, the method for mounting the connector on these circuits is characterized by the fact that the guide is adapted to assume a premounting position whereby the plugs are covered, and a mounting position whereby the plugs are exposed following pressure applied to the second circuit.

Advantageously the means, such as the projections coming out of the first part of the guiding means, are contemplated so as to hold the guide in its premounting position.

These means are crossed when pressure is applied to the guide using the second or first circuit to release the free ends of the plugs.

It can be seen that there is no risk that the plugs will be bent.

Advantageously, the plugs are fitted into the housings that pass through the tight sliding guide, while a tighter slide mounting is placed between the two parts of the guiding means to prevent the guide from loosening, without bending the plugs and facilitating guiding.

Advantageously, in a simple and economical fashion, the first part of the guiding means comprises posts, each of which are firmly attached and which slide in an additional hole made in the guide, comprising the second part of the guiding means.

Advantageously, the base and guide are made of an electrically insulating material so that inexpensive parts with complex shapes can be obtained by molding.

Accordingly, in one embodiment the base is equipped with means whereby it can be attached by snapping onto the first or second circuit, while the posts are the result of molding with the base.

In general, these means of mounting the base onto the first or second circuit comprise projections, such as pins, and can be introduced into the axial extension of the guiding posts.

The plugs can also be easily attached to the base, for example by overmolding, snapping together or force fitting into the attachment housings contemplated for this purpose in the base.

The posts can advantageously be of one piece with the base in order to reduce the number of parts and make guiding more reliable, or they can be brought into contact with the base in the same way as referred to above for the plugs.

In one embodiment, the posts are of one piece with the means contemplated for attaching the base to the first or second circuit.

Advantageously the plugs are mounted in the base with a tighter fit than that existing between the plugs and their associating guide housings.

By means of this arrangement, the guide can be brought into contact with the base while having a premounted connector that will not come loose.

In one embodiment the plugs comprise tabs with a chamfered free end and a folded support foot in order to increase the contact surface with the exposed electrical areas of the first or second circuit.

The free ends of the posts are also advantageously chamfered.

Based on the invention, these tabs do not need to be oversized because they are carefully handled.

In a variation, the plugs comprise cylindrical pins with a free end of a penetrating shape.

In one embodiment, every plug is mounted on the base so that the guide has all the housings for the tabs, which simplifies manufacture of the base forming the male element of the connector and the guide forming the female element of the connector.

In a variation, the base holds part of the plugs, advantageously most of them, and the guide the rest of the plugs so that the housings are in the base and the plugs in the guide.

All of the foregoing depends on the applications and circuit shape.

In accordance with another characteristic, the plugs are advantageously allowed to pass through the openings of the second or first circuit with more play than that existing between the plugs and their associated guide housings, to compensate for manufacturing tolerances, in particular tolerances for positioning the plugs in the first circuit.

BRIEF DESCRIPTION OF THE DRAWINGS

The invention will be better understood, and other purposes, characteristics, details, and advantages of the invention will appear more clearly in the following explanation regarding the enclosed drawings, solely by way of example, showing one embodiment of the invention, wherein:

FIG. 2 is a frontal view of the connector in accordance with the invention prior to being mounted on the two electronic circuits between which it is located;

FIG. 3 is a view similar to that of FIG. 1, with the connector base attached to the first circuit while the second circuit presses against the connector guide;

FIG. 4 is a partial frontal view, without the base and connector guide, showing the final mounting of one of the plugs on the two electronic circuits between which the inserted connector is placed.

DESCRIPTION OF PREFERRED EMBODIMENTS OF THE INVENTION

Figure 1:
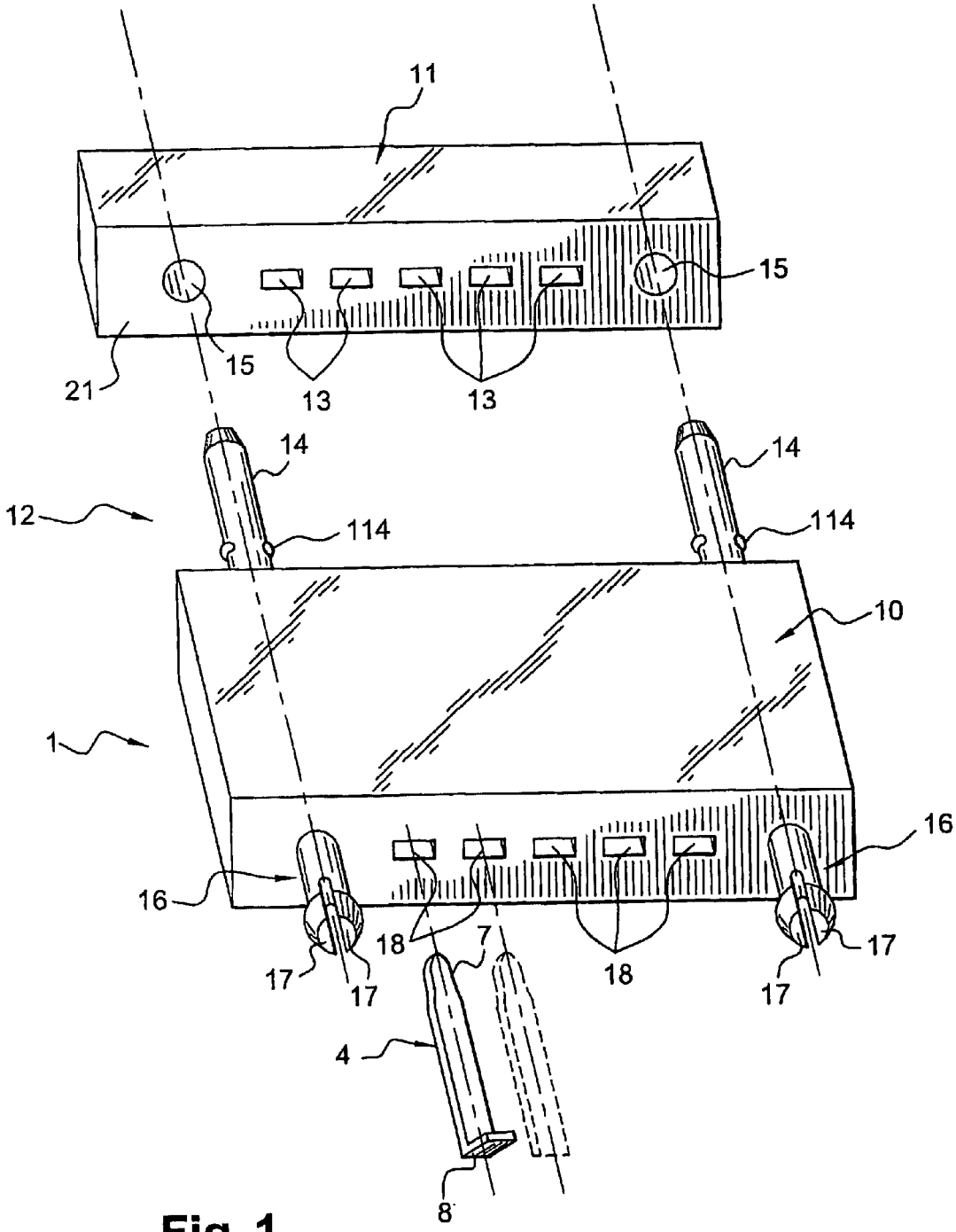
FIG. 1 is a perspective view of an inserted connector in accordance with the invention, two of whose plugs have not yet been mounted on the connector base.

The aforesaid figures show an inserted electrical connector 1 intended to interlink two superimposed electronic circuits 2, 3 partially shown in FIGS. 3 and 4.

The aforesaid connector has several electrically conducting plugs 4, also known as pins, each of which is intended to ensure an electrical link between a first electrical contact area 5 borne in the figures by the first electronic circuit 2 and a second electrical contact area 6 borne by the second electronic circuit 3 mounted on top of the first circuit 2 so that two stages are formed between which the connector 1 is inserted.

In this instance, each circuit 2, 3 has a board whereby the electrical contact areas 5, 6 are exposed on the upper face of the boards, which in particular bear, as is commonly known, electrical and electronic components and metal tracks and/or channels linking with the areas 5, 6.

The plugs ensure an electrical link between the areas 5, 6 so that information can pass from one circuit to another electrically.

In this embodiment, the plugs 4 comprise metal tabs of rectangular cross-section with a head 7, comprising the free end of the tab 4 of a penetrating shape, and a foot 8 extending at 90° from the plane of the tab 1.

In the figures, the foot 8 is intended to make electrical contact with the first electrical contact area 5 of the first lower circuit 2. The link between the foot and this first area is for example made by applique or through soldering.

In one aspect, the foot makes it possible to obtain good electrical contact with the area 5 as well as a large soldering area, and good seating of the connector with regard to the lower circuit 2.

The head 7 is allowed to pass through, with play in this instance to compensate for manufacturing tolerances, an associated opening 9 made in the second upper circuit 3. This opening 9 is delimited by the second contact area 6, with the link between the head 7 and the area 6 being created by soldering.

The connector 1 cannot come loose, and can be readily handled and moved. This connector comprises three parts 10, 11, 12, i.e., a base 10, a guide 11 and guiding means 12.

More specifically, in accordance with the invention the inserted connector comprises a base 10 made of electrically insulating material holding to which are attached plugs 4, a guide 11 made of electrically insulating material and a guiding means 12 located between the guide 11 and the base 10. At least some of the plugs 4 protrude from the base 10 so that each can be received by their free sliding end or head 7 in a housing 13 passing through the guide 11. The guiding means 12 comprise a protruding first part 14 attached to the base 10 and an additional second part 15 mounted so as to slide on the first part 14 and attached to the guide 11. The first part 14 is intended to be guided through the second part 15 as in the figures, with the second circuit 3 having openings 22, in the shape of holes here, for this purpose.

In the figures, the base 11 is intended to be attached to the first circuit 2 using the assembly means 16.

The tabs 4 pass through the base 10. Here every tab 4 is held by the base 10, the heads 7 and the feet 8 extending from one side of the base to the other.

In the figures, the base 10, the guide 11 and the guiding means are made of moldable and electrically insulating plastic. These parts 10, 11 have an overall parallelepipedic shape.

Naturally in a variation the parts 10, 11 have another shape. These parts may have a square, polygonal, circular, or other cross section.

The guiding means 12 comprising a first part in the shape of two posts 14 projecting from the upper face 19 of the base at a height greater than that of the part of the plugs 4 projecting from this face 19. In this instance, the first part 14 of the guiding means 12 is of a single piece with the base 10, having been molded along with the base. This first part comprises cylindrical posts 14 with a circular cross-section. In a variation, the posts contact the base.

Here the second part of the guiding means 12 comprise holes 15 that supplement the posts 14. The holes 15 pass through the guide 11 and here have a circular section. In a variation, the cross section of the posts 14 and the holes is not circular, for example being rectangular or square.

This instance contemplates two posts 14 and two holes 15.

Each post 14 has a free chamfered end to facilitate its mounting in the holes 15 as well as in the holes 22 of the circuit 3 aligned with the holes 15.

The posts 14 and the holes 15 extend close to the lateral faces of the base 10 and the guide 11, respectively.

The guide 11 is also able to run along the posts, advantageously with a tight sliding fit.

In a variation, the guiding means 12 are installed on the lateral faces of the base and guide and comprise a sliding system and a guiding rail.

The assembly means 16 also involve molding with the base 10 and in this instance comprise projections in the shape of protruding pins that face in the opposite direction to the posts 14, with which they are aligned.

These pins 16 have two flanged tabs 17 owing to a groove (not shown). Naturally more than two tabs and thus more than two grooves can be contemplated.

As can be seen in FIG. 3, the pins are intended to pass through an additional opening (not shown) made in this instance in the first circuit 2 so that the tabs 17 are capable of tightening due to the grooves while passing through the opening, and then to be deployed so that their flange will contact the lower face of the circuit 2.

Here the attachment of the base 10 to the circuit 2, more specifically to the circuit board, is accordingly achieved by snapping together. The number of pins naturally depends on the applications, and in one variation is more than two, for example one pin being contemplated close to each corner of the base.

In a variation the pins 16 are smooth, and once they pass through the associated opening in the circuit board 2 they are advantageously bent under heat to be riveted to the base 10 on the circuit 2.

In a variation the base is screwed or bolted to the circuit board 2.

The base also comprises several housings 18 that match the housings 13 of the guide 11.

Here the housings 18, 13 have a rectangular section corresponding to that of the tabs 4.

The tabs 4 are anchored in the housings 18, for example by force fitting.

To complete this anchoring, a variation of the tabs 4 has side projections, for example in saw tooth shape, so that they cannot pull out of the base.

Based on the foregoing and in accordance with one advantageous characteristic, the tabs 4 are mounted in the housings 18 of the base more tightly than are the tabs 4 in the associated housings 13 of the guide 11.

In accordance with another characteristic, the tabs 4 are inserted into the housings 13 of the of the tight sliding guide 11, while a tighter sliding assembly is created between the two parts 14, 15 (the posts 14 and their associated holes 15) of the guiding means 12 so that the guide will not loosen, the tabs will not be bent, and guiding will be rendered easier.

In accordance with another characteristic, the tabs 4 are advantageously allowed to pass through the openings 9, the holes in this case, which in the figures are made in the second circuit with more play than that existing between the tabs 4 and the associated housings 13 of the guide 11 to compensate for manufacturing tolerances.

With this invention, in a first stage the tabs 4 are inserted into the additional housings 18 on the base, now fitted with posts 14 and pins 16 of a single piece with the base, to form a male connector part 1 comprising the base holding the projecting pins 16, the posts 14 and to which the projecting tabs 4 are attached. The female part of the connector 1 is comprised of the guide 11.

Based on the foregoing and as shown in the figures the posts 14 and tabs 4 protrude parallel to the upper face 19 of this base, and the posts 14 protrude from the tabs 4 to pass through the holes 15 of the guide 11, 22 and the upper circuit board 3.

Therefore the length of the posts depends on the applications, and in particular the distance between the two circuits 2, 3 and the thickness of the guide 11 and base 10.

In a second step, the guide 11, using its holes 15, is slid onto the posts 14 and pushed further along to arrive at the configuration of FIG. 2 wherein the free ends 7 of the tabs 4 are embedded in the housings 13 of the guide without going beyond the upper face 20 of the guide. Now there is play J between the lower face 21 of the guide and the upper face 19 of the base 10.

This guide position corresponds to a premounting position of the connector.

Advantageously, the posts are equipped with at least one short projection, several of them 114 as shown here, to keep the guide 11 in the connector premounting position due to the matching of the projections 114 with the lower face 21 of the guide 11.

In this manner an assembly is created that can be readily handled and moved without coming loose, in particular due to the tighter mounting between the posts 14 and holes 15.

In a third step, the base, by means of its pins 16, is in this instance snapped onto the first circuit and the feet 8 of the tabs are soldered onto the areas 5.

In a fourth step, the circuit board 3 shown here is inserted onto the posts 14. To do so, the board has holes 22 as referred to above, adapted so that the posts 14 can slide through it with a tight fit. Next, constant pressure P is exerted on the circuit board 3 so as to move it, as well as the guide 11 whose upper face contacts this board, so that the free ends 7 of the tabs 4 will be freed from the guide 11 and these ends 7 will be inserted into the holes 9.

During this fourth step, the guide 11 is allowed to clear the low projections 114.

The structures can naturally be reversed, inasmuch as the posts are equipped with at least one groove wherein a projection can enter to keep the guide 11 in the connector premounting position.

Accordingly, the connector is equipped with a means of keeping the guide in the connector premounting position.

Advantageously the play between the holes 22 and posts 14 is less than the play between the tabs 4 and holes 9, to compensate for manufacturing tolerances and to render mounting easier.

Accordingly, the play J shown in FIG. 2 is reduced to arrive at the final position shown in FIG. 4.

In a fifth step while in this final position, the tabs 4 are soldered onto the areas 6.

In this final position, there is mounting play between the faces 21 and 19.

In a variation, the connector forms a crosspiece between the two circuits 2, 3.

It can be seen that soldering is easy, in particular owing to the feet 8 that increase the surface of the soldering areas.

The structures can naturally be reversed to achieve a variation whereby the base is attached to the second circuit while the posts 14 cross through the first circuit.

In accordance with the invention, the circuit boards 2, 3 along with the connector 1 can form part of an electronic command and control box for an alternator-starter, which, as is known, is a multi-phase reversible alternator that can also function as an electric motor, in particular to start up the thermal engine of an automobile as described in documents WO 01/69762 and FR A 2 745 444.

This rotary electrical machine contains a hollow support forming a casing for attaching the machine to a fixed part, a stator, and a rotor, with one embodiment having a ventilation device with at least one internal fan.

The stator surrounds the rotor, which is attached to a rotor shaft.

The rotor, in one embodiment for example as described in document EP A 0515 529 and its US counterpart, A 5 270 605, has an internal fan on at least one of its axial ends to cool the alternator-starter, the support being cut out, by a known means, to create air inlets and outlets and to circulate air when the fan rotates.

In a variation, the alternator can be water cooled by means of a channel in the support, and can also be outfitted with axial fans attached to its rotor. This support comprises at least two parts, i.e., a front and rear bearing as described in the abovementioned document EP A 0515 259. In a variation, the support has more than two parts.

The outer periphery of the support contains a wound stator, equipped with central bearings, such as with one or two rows of balls, for rotary mounting of the rotor shaft so that the rotor and stator are mounted inside the support, advantageously in two parts know as the forward and rear bearing. As described in document WO 01/69762, the rotor is for example a claw-pole (Lundel) rotor equipped with a motor field.

In a variation, the rotor is a salient-pole rotor or a hybrid type (permanent magnets and salient poles), as described in document WO 02/054566.

In the aforesaid document, the rotor comprises a bundle of plates cut so as to create housings for the permanent magnets, and to create arms around which the motor fields are wound. The magnet housings are closed off by nonmagnetic support parts with grooves to receive the motor fields. These parts extend from one side to the other of the bundle of plates by virtue of being attached to this bundle, for example by using tie bars passing through the parts and the bundle of plates.

Stator windings may include bar-shaped conductor components, such as pins of an overall U-shape, and with a cross section advantageously rectangular as described in patent FR A 2 820 896.

In a variation, each stator winding has one triangular and one star winding of differing sections mounted in the same recesses as described in patents U.S. Pat. No. 4,163,187 and FR A 2 737 063.

In each case, the machine stator comprises a body resting on the fixed support and windings whose phase outlets are intended to be connected to the electronic command and control box, for example by a connecting device with cables linked to the alternator-starter phase outlet by means of a first connector and a second connector to the electronic command and control box. This second connector is itself connected inside the box to a MOSFET-type transistor bridge controlled by signals from a control unit as described in patent FR A 2 745 444. This bridge is a rectifier and phase-control bridge for stator windings on the alternator-starter whereby the device serves as an alternator or starter, in particular to start the automobile engine.

In this case the box circuit 2 is a power circuit equipped with MOSFET-type transistors and box circuit 3 is a control and command circuit housing the aforementioned command unit. This circuit comprises logic components. Command signals are then transmitted using the connector 1.

Accordingly, the circuit 2 comprises a power stage near the bottom of the box equipped with a heat sink, for example with fins or as a variation with circulating liquid. The circuit 3 is a control and command stage located away from stage 2 that draws off heat.

In a variation, this electronic command and control box is mounted on the alternator-starter as described for example in the aforementioned document WO 01/69762.

In another variation, the circuits 2, 3 and the connector 1 can be mounted in a DC converter as described in patent application FR 02 05098, filed on Apr. 12, 2003, which can be referred to for additional explanation.

All combinations are possible.

What is claimed is:

1. An inserted electrical connector for interlinking two superimposed electronic circuits comprising:

electrically conducting plugs each of which is intended to ensure an electrical connection between a first electrical contact area borne by the first electronic circuit and a second electrical contact area borne by the second electrical circuit;

a base made of electrically insulating material with plugs;

a guide made of electrically insulating material; and a guiding means attached thereto and located between the guide and the base;

wherein at least some of the plugs project from the base so that the free end of each one can fit into and slide in a housing passing through the guide;

wherein the guiding means comprises a projecting first part attached to the base and an additional second part mounted on the first part and attached to the guide; and wherein the plugs are fitted into associated housings passing through the guide while a tighter sliding assembly is located between the two parts of the guiding means.

2. The connector of claim 1, wherein the base comprises housings and wherein the plugs are mounted in the housings of the base with a tighter fit than that existing between the plugs and the associated housings of the guide.

3. The connector of claim 1, wherein the first part of the guiding means forms one piece with the base.

4. The connector of claim 1, wherein said connector interlinks with a first electronic circuit pertaining to a power stage and a second electronic circuit pertaining to a control stage.

5. The connector of claim 4, wherein both stages are mounted in an electronic command and control box of an automobile alternator-starter.

6. An inserted electrical connector for interlinking two superimposed electronic circuits comprising:

electrically conducting plugs each of which is intended to ensure an electrical connection between a first electrical contact area borne by the first electronic circuit and a second electrical contact area borne by the second electrical circuit;

a base made of electrically insulating material with plugs;

a guide made of electrically insulating material; and a guiding means attached thereto and located between the guide and the base;

wherein at least some of the plugs project from the base so that the free end of each one can fit into and slide in a housing passing through the guide;

wherein the guiding means comprises a projecting first part attached to the base and an additional second part mounted on the first part and attached to the guide;

wherein one of the electronic circuits known as the second circuit, have first holes and wherein the plugs pass through the first holes, with more play than that existing between the plugs and the associated housings of the guide; and wherein the second circuit comprises second holes and wherein the first part of the guiding means passes through the second holes of the second circuit with less play than that between the plugs and the first holes.

7. The connector of claim 6, wherein the first part of the guiding means projects from the base to a height greater than that of the projecting part of the plugs above the base.

8. The connector of claim 6, wherein the first part of the guiding means forms one piece with the base.

9. The connector of claim 6, wherein said connector interlinks with a first electronic circuit pertaining to a power stage and a second electronic circuit pertaining to a control stage.

10. An inserted electrical connector for interlinking two superimposed electronic circuits comprising:

electrically conducting plugs each of which is intended to ensure an electrical connection between a first electrical contact area borne by the first electronic circuit and a second electrical contact area borne by the second electrical circuit;

a base made of electrically insulating material with plugs;

a guide made of electrically insulating material; and a guiding means attached thereto and located between the guide and the base;

wherein at least some of the plugs project from the base so that the free end of each one can fit into and slide in a housing passing through the guide, wherein the guiding means comprises a projecting first part attached to the base and an additional second part mounted on the first part and attached to the guide; and wherein the first part of the guiding means comprises posts each of which fits tightly so as to slide through an additional hole made in the guide and comprising the second part of the guiding means.

11. The connector of claim 10, wherein the first part of the guiding means forms one piece with the base.

12. The connector of claim 10, wherein said connector interlinks with a first electronic circuit pertaining to a power stage and a second electronic circuit pertaining to a control stage.

13. The connector of claim 10, wherein the base is equipped with projections for attaching said base to another electronic circuit known as the first circuit.

14. The connector of claim 13, wherein the projections comprise pins with flanged tabs on their free end owing to at least one groove and wherein the pins are intended to pass through an additional opening in the first circuit in order to be attached by snapping onto the base on the first circuit.

15. An inserted electrical connector for interlinking two superimposed electronic circuits comprising:

electrically conducting plugs each of which is intended to ensure an electrical connection between a first electrical contact area borne by the first electronic circuit and a second electrical contact area borne by the second electrical circuit;

a base made of electrically insulating material with plugs;

a guide made of electrically insulating material; and a guiding means attached thereto and located between the guide and the base;

wherein at least some of the plugs project from the base so that the free end of each one can fit into and slide in a housing passing through the guide;

wherein the guiding means comprises a projecting first part attached to the base and an additional second part mounted on the first part and attached to the guide; and wherein the plugs comprise metal tabs of rectangular section with a head, comprising the free end of the tab in a penetrating shape, and a foot extending at a 90 degree angle to the plane of the tab.

16. The connector of claim 15, wherein the foot is intended to make electrical contact with the first electrical contact area of the first circuit.

17. The connector of claim 15, wherein the first part of the guiding means forms one piece with the base.

18. The connector of claim 15, wherein said connector interlinks with a first electronic circuit pertaining to a power stage and a second electronic circuit pertaining to a control stage.

19. A method for mounting an electrical connector for interlinking two superimposed electronic circuits, the electrical connector comprising:

electrically conducting plugs each of which is intended to ensure an electrical connection between a first electrical contact area borne by the first electronic circuit and a second electrical contact area borne by the second electrical circuit;

a base made of electrically insulating material with plugs;

a guide made of electrically insulating material; and a guiding means attached thereto and located between the guide and the base;

wherein at least some of the plugs project from the base so that the free end of each one can fit into and slide in a housing passing through the guide;

wherein the guiding means comprises a projecting first part attached to the base and an additional second part mounted on the first part and attached to the guide;

wherein the guide is intended to occupy a premounting position whereby the guide covers the free ends of the plugs and a mounting position whereby the free ends of the plugs are uncovered; and wherein means are contemplated for maintaining the guide in the premounting position.

* * * * *